US009797056B2

(12) United States Patent
Weyhmueller et al.

(10) Patent No.: US 9,797,056 B2
(45) Date of Patent: Oct. 24, 2017

(54) ELECTROLYTE FOR THE ELECTROLYTIC DEPOSITION OF SILVER-PALLADIUM ALLOYS AND METHOD FOR DEPOSITION THEREOF

(71) Applicant: UMICORE GALVANOTECHNIK GMBH, Schwaebisch Gmuend (DE)

(72) Inventors: Bernd Weyhmueller, Alfdorf Hintersteinenberg (DE); Uwe Manz, Moegglingen (DE); Sascha Berger, Schwaebisch Gmuend (DE)

(73) Assignee: Umicore Galvanotechnik GMBH, Schwaebisch Gmuend (DE)

( * ) Notice: Subject to any disclaimer, the term of this patent is extended or adjusted under 35 U.S.C. 154(b) by 0 days.

(21) Appl. No.: 14/910,138

(22) PCT Filed: Jul. 24, 2014

(86) PCT No.: PCT/EP2014/065958
§ 371 (c)(1),
(2) Date: Feb. 4, 2016

(87) PCT Pub. No.: WO2015/018654
PCT Pub. Date: Feb. 12, 2015

(65) Prior Publication Data

US 2016/0177462 A1 Jun. 23, 2016

(30) Foreign Application Priority Data

Aug. 6, 2013 (DE) ..... 10 2013 215 476

(51) Int. Cl.
*C25D 3/56* (2006.01)
*C25D 3/64* (2006.01)
(Continued)

(52) U.S. Cl.
CPC ..... *C25D 3/64* (2013.01); *C25D 21/02* (2013.01); *C25D 21/14* (2013.01)

(58) Field of Classification Search
CPC ..... C25D 3/567; C25D 3/64
(Continued)

(56) References Cited

U.S. PATENT DOCUMENTS 4,465,563 A 8/1984 Nobel
4,478,692 A * 10/1984 Nobel ..... C25D 3/567 205/257
(Continued)

FOREIGN PATENT DOCUMENTS

DE 2914880 A1 10/1980
EP 1905871 A1 4/2008

OTHER PUBLICATIONS

Cobley, A.J. et al. The use of insoluble anodes in Acid Sulphate Copper Electrodeposition Solutions, Trans IMF, 2001,79(3), pp. 112 to 118).
(Continued)

*Primary Examiner* — Edna Wong
(74) *Attorney, Agent, or Firm* — Smith, Gambrell & Russell, LLP

(57) ABSTRACT

The present invention relates to an electrolyte and to a method for the electrolytic deposition of silver-rich silver-palladium alloys which to a minor degree also include selenium and/or tellurium. The electrolyte of the invention allows uniform deposition of such an alloy on conductive surfaces across a wide range of current densities.

23 Claims, 4 Drawing Sheets

Figure 1:
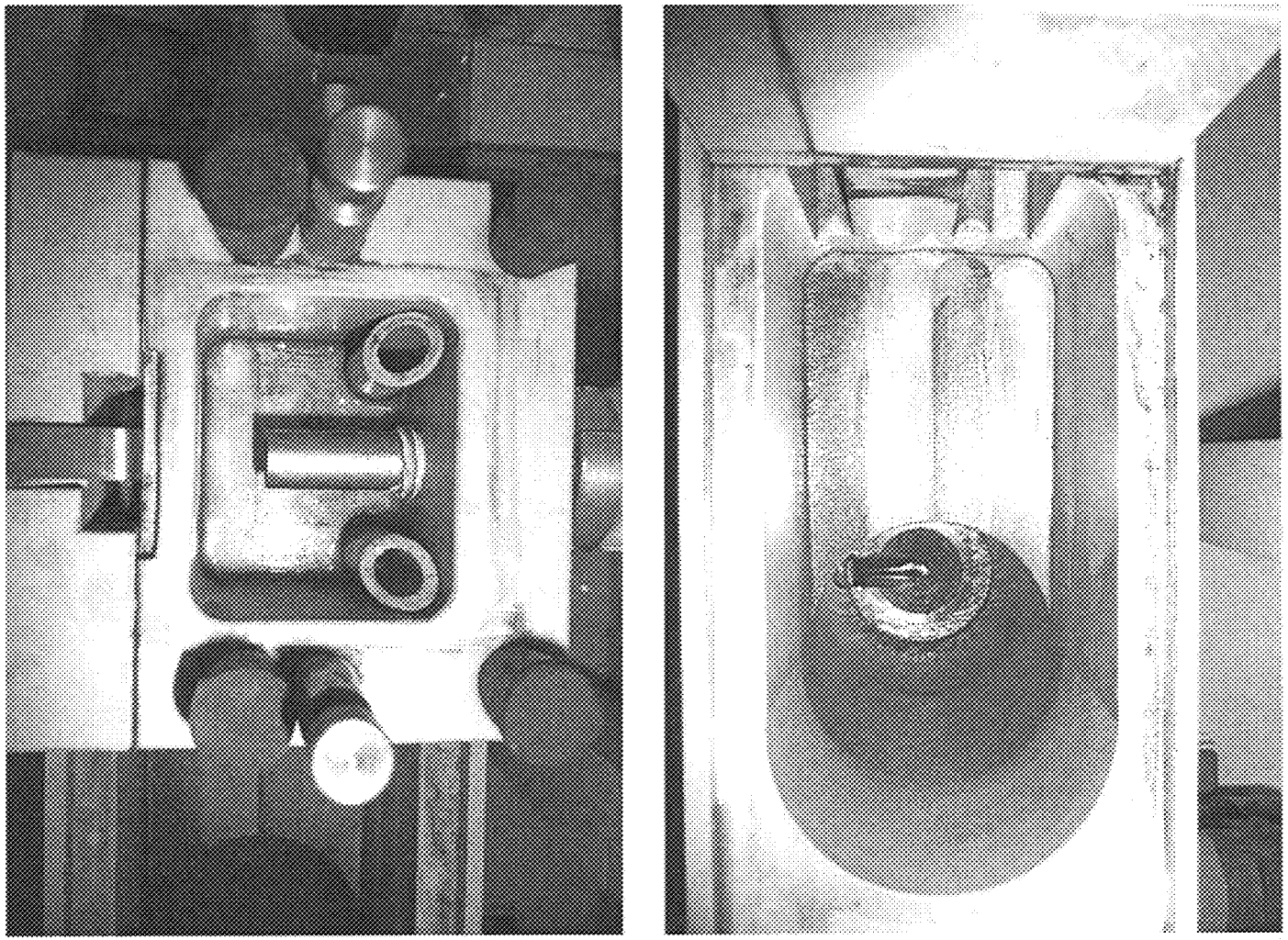

(51) Int. Cl.
*C25D 21/02* (2006.01)
*C25D 21/14* (2006.01)

(58) Field of Classification Search
USPC ..... 205/238, 257, 259
See application file for complete search history.

(56) References Cited

U.S. PATENT DOCUMENTS 4,673,472 A * 6/1987 Morrissey ..... C25D 3/567 205/257
5,882,736 A * 3/1999 Stein ..... C23C 18/42 106/1.15
6,251,249 B1 * 6/2001 Chevalier ..... C23C 18/42 205/159
2008/0073218 A1 * 3/2008 Ishikawa ..... B01D 53/228 205/50
2009/0283411 A1 * 11/2009 Aksu ..... C25D 3/54 205/109
2011/0147225 A1 * 6/2011 Zhang-Beglinger ..... C25D 3/52 205/257

OTHER PUBLICATIONS

Written Opinion of the International Searching Authority for PCT/EP2014/065$58; dated Dec. 4, 2014 in English.

International Search Report for PCT/EP2014/065958, dated Dec. 4, 2014 in English.

Kanapi, N: Galvanotechnik [Electroplating]: Hanser Verlag, Munich Vienna, 2000; pp. 84-86.

Edelmetallschichten [Precious metal coats], H. Kaiser, 2002, pp. 52-61, 70-73, 120-123, Eugen G. leuze Verlag.

Elektrochemie. Galvanotechnik. Korrosion. Project AiF14160N. Forschungsinstitut für Edelmetalle & Metallchemie (FEM) aus Schwäbisch Gmänd, pp. 1-3 (date not indicated).

Marjorie Myers: Overview of the Use of Silver in Connector Applications; Interconnect & Process Technology, Tyco Electronics Harrisburg, Feb. 2009.

Written Opinion of the International Searching Authority for PCT/EP2014/065958; dated Dec. 4, 2014 in English.

* cited by examiner

ELECTROLYTE FOR THE ELECTROLYTIC DEPOSITION OF SILVER-PALLADIUM ALLOYS AND METHOD FOR DEPOSITION THEREOF

The present invention relates to an electrolyte and to a method for the electrolytic deposition of silver-rich silver-palladium alloys which to a minor degree also include selenium or tellurium. The electrolyte according to the invention allows uniform deposition of a corresponding alloy on conductive surfaces across a wide range of current densities.

Electrical contacts are nowadays installed in virtually all electrical devices. Their application ranges from simple plug connectors through to safety-relevant, high-performance switching contacts in the communications sector, for the automobile industry, or for the aerospace segment. The surfaces of these contacts are required to display high electrical conductivities, low contact resistances that are stable over the long term, and also high corrosion and wear resistance with minimal plugging forces. In electrical engineering, plug contacts are often coated with a hard gold alloy coat consisting of gold-cobalt, gold-nickel or gold-iron. These coats possess good wear resistance, good solderability, a low contact resistance which is also stable over the long term, and high corrosion resistance. On account of the rising price of gold, more favorably priced alternatives are sought.

Coating with silver-rich silver alloys (hard silver) has proven advantageous as a substitute for coating with hard gold. On account of their high electrical conductivity and high oxidation resistance as well, silver and silver alloys are among the most significant contact materials in electrical engineering. Depending on the metal alloyed in, these silver alloy coats have coat properties similar to those of the hitherto employed hard gold coats or coat combinations such as palladium-nickel with gold flash, for example. A further factor is that the price of silver is relatively low by comparison with other precious metals, especially hard gold alloys.

One restriction on the use of silver is the lower corrosion resistance of the silver relative to hard gold, for example, in atmospheres containing sulfur and containing chlorine. Apart from the visible alteration to the surface, silver sulfide tarnish layers usually pose no great risk, since silver sulfide is semiconducting, soft, and in general easily displaced by the wiping plug-in procedure where contact forces are sufficient. Silver chloride tarnish layers, in contrast, are nonconducting, hard, and not easily displaceable. Consequently, a sizable fraction of silver chloride in the tarnish layer leads to problems with the contact properties (reference: Marjorie Myers: Overview of the Use of Silver in Connector Applications; Interconnect & Process Technology, Tyco Electronics Harrisburg, February 2009).

In order to increase the corrosion resistance, other metals can be alloyed in to the silver. One metal that makes a suitable alloying partner for silver in this context is palladium. Silver-palladium alloys are sulfur-resistant, for example, if the palladium fraction is appropriately high (DE 2914880 A1).

Palladium-silver alloys have already been used successfully as wrought alloys for some considerable time as contact material. In relay switching contacts, 60/40 palladium-silver alloys are preferably used as an inlay. These coatings of electrical contact materials based on precious metal are nowadays also preferably produced galvanically.

Although the electrochemical deposition of the palladium-silver alloy coats, from usually alkaline electrolytes, has already been thoroughly investigated, it has not proved possible to date to develop any electrolytes with practical functionality, in part because the palladium-silver alloy coats deposited did not meet the requirements in terms of quality and composition. The acidic electrolyte mixture described so far in the literature and in patents are based predominantly on thiocyanate, sulfonate, sulfate, sulfamate, or nitrate electrolytes. Still common at present to all electrolytes, however, is the latent lack of stability of the electrolyte systems (Edelmetallschichten [Precious metal coats], H. Kaiser, 2002, p. 52, Eugen G. leuze Verlag).

U.S. Pat. No. 4,673,472 A discloses the electrolytic deposition of palladium-rich alloys with 10-20% silver as a constituent from baths based on sulfamic acid. The pH of the baths is around 2.5. Light-colored, bright depositions are obtained in a current density range of 0-20 A/dm$^2$ in the presence of amino acids. Other sulfur-containing additives are used for these electrolytes, as additional brighteners and for stabilization.

According to U.S. Pat. No. 4,465,563 A, silver-palladium alloys can be deposited electrolytically from an acidic aqueous solution which comprises organic sulfonic acids as a constituent. The resulting alloys are then in general palladium-rich.

In a research institute report (Forschungsinstitut für Edelmetalle & Metallchemie aus Schwäbisch Gmünd) it is said that the employable current density range in the electrolytic deposition of silver-palladium alloys from sulfonic acid electrolytes can be extended by the addition of tellurium compounds and/or selenium compounds (project number AiF 14160 N).

In spite of the numerous existing electrolytes in the area of the electrolytic deposition of silver-palladium alloys, there continues to be a need to offer electrolytes which are superior in practical use to the electrolytes of the prior art. For industrial application, such electrolytes ought to have sufficiently high stability and ought to permit the deposition of stable alloy compositions across the broadest possible current density range. The electrolytes ought also to remain fully functional even after high current density exposure, and the depositions produced with these electrolytes ought to be homogeneous and advantageous with regard to their use in contact materials.

These and other objects evident in an obvious way to the skilled person from the closest prior art are achieved by an electrolyte in accordance with the present invention. Protection is sought for other preferred embodiments in the claims. The present invention also relates to a preferred method for the deposition of silver-palladium alloys, in which the electrolyte of the invention is employed.

The stated objects are achieved very advantageously, though no less surprisingly, through the use of a cyanide-free, acidic, and aqueous electrolyte for the electrolytic deposition of silver-palladium alloys comprising predominantly silver, said electrolyte comprising in dissolved form the following constituents:

1) a silver compound in a concentration of 0.01-2.5 mol/l silver;
2) a palladium compound in a concentration of 0.002-0.75 mol/l palladium;
3) a tellurium compound or selenium compound in a concentration of 0.075-80 mmol/l tellurium/selenium;
4) urea in a concentration of 0.2-2 mol/V, and/or one or more amino acids selected from the group consisting of the following:

alanine, aspartic acid, cysteine, glutamine, glutamic acid, glycine, lysine, leucine, methionine, phenylalanine, phenylglycine, proline, serine, tyrosine, and valine, in a concentration of 0.2-40 mmol/l; and 5) a sulfonic acid in a concentration of 0.25-4.75 mol/l.

Figure 2:
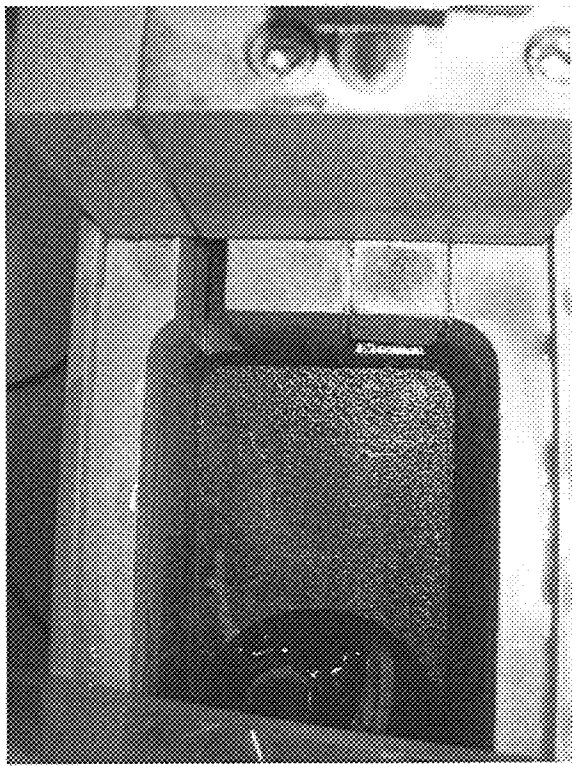
Figure 2:
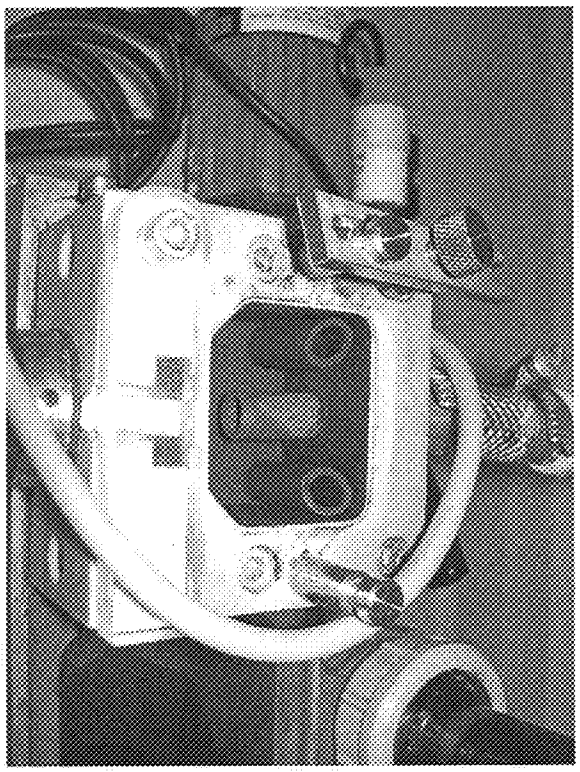

With the present electrolyte, homogeneous depositions with a uniform composition can be achieved across a wide current density range, with outstanding suitability for use and hence for the replacement of hard gold alloys in contact materials. The electrolyte of the invention displays a comparatively high stability, making it look particularly advantageous in industrial application (FIGS. 1 and 2). With the present electrolyte based on sulfonic acid, high-quality electrical contact materials can be produced advantageously even in frame coating lines and high-speed coating lines. The electrolyte preferably contains only the constituents specified above.

The deposited silver-palladium-tellurium or silver-palladium-selenium alloys have a composition with about 50-99% by weight of silver (remainder palladium and tellurium/selenium). In accordance with the invention, the concentrations of the metals for deposition are adjusted in the electrolyte within the boundaries specified above, in such a way as to result in a silver-rich alloy. It may be noted that as well as the concentration of the metals to be deposited, the silver concentration in the deposited alloy is also influenced by the current density employed, the fraction of sulfonic acid used, and the amount of tellurium compound and/or selenium compound added. The skilled person is aware as to how the parameters in question must be set in order to obtain the desired target alloy, or is able to determine this by means of routine experiments. The aim preferably is for an alloy in which the silver has a concentration of 70-99% by weight, more preferably 75-97% by weight, and very preferably 85-95% by weight. In contrast to the teaching of the prior art, it has emerged that even the inventive alloys with less than 30% by weight of palladium have an appropriate corrosion resistance. The other constituents of the alloy are—as stated—palladium and either tellurium or selenium. The latter are represented in the alloy, in general, in a concentration of less than 10%, preferably less than 5%, and very preferably less than 4% by weight. Palladium then forms the remainder of the deposited metal. One particularly preferred composition has about 90% by weight silver, 7-8% by weight palladium, and 3-2% by weight tellurium and/or selenium.

The electrolyte of the invention comprises urea and/or an α-amino acid as indicated above, which serve as complexing agents for the palladium and contribute to increasing the stability of the electrolyte present. Employed at present preferably are those amino acids which have only alkyl groups in the variable radical. Additionally preferred is the use of amino acids such as alanine, glycine. and valine. Especially preferred is the use of glycine and/or alanine. Within the concentration boundaries indicated above, the skilled person is able freely to select the optimum concentration for the amino acid used. Said skilled person will be guided by the consideration that too small amount of an amino acid does not give the desired stabilizing effect, while the use thereof at too high a concentration may inhibit the deposition of palladium. It has therefore proven particularly advantageous if the palladium is added to the electrolyte in the form already of a corresponding palladium-amino acid complex.

The electrolyte of the invention is used in an acidic pH range. Optimum results are achievable at pH values in the electrolyte of <2. The skilled person is aware of how the pH of the electrolyte may be adjusted. Said skilled person will allow themselves to be guided by the thought of introducing into the electrolyte as little as possible of additional substances which may adversely affect the deposition of the alloy in question. In one especially preferred embodiment the pH is governed solely by the addition of the sulfonic acid. This then preferably produces strongly acidic deposition conditions, under which the pH is below 1 and may possibly even be down to 0.1, in limiting cases even down to 0.01. In the optimum scenario, the pH is around 0.6.

The metal compounds which may be added to the electrolyte are generally familiar to the skilled person. As a silver compound for addition to the electrolyte it is possible with preference to employ a silver salt that is soluble in the electrolyte. These salts may especially be selected from the group consisting of silver methane sulfonate, silver carbonate, silver sulfate, silver phosphate, silver pyrophosphate, silver nitrate, silver oxide, and silver lactate. Here as well the skilled person should be guided with the principle that as little as possible of additional substances are to be added to the electrolyte. Very preferably, therefore, the skilled person will select silver methanesulfonate, silver carbonate, or silver oxide as the silver salt to be added. As far as the concentration of the silver compound used is concerned, the skilled person will have been guided by the limiting values specified above. The silver compound is present in the electrolyte preferably in a concentration of 0.01-2.5 mol/l silver, more preferably 0.02-1 mol/l silver, and very preferably between 0.05-0.2 mol/l silver.

The palladium compound for use is also employed preferably in the form of a complex which is soluble or salt which is soluble in the electrolyte. The palladium compound used here is preferably selected from the group consisting of palladium hydroxide, palladium chloride, palladium sulfate, palladium pyrophosphate, palladium nitrate, palladium phosphate, palladium bromide, palladium P salt (diamminedinitritopalladium(II); ammoniacal solution), palladium glycinate, and palladium acetate. This palladium compound is added to the electrolyte in a concentration as indicated above. The palladium compound is employed preferably in a concentration of 0.002-0.75 mol/l palladium, the concentration being very preferably 0.035-0.2 mol/l palladium in the electrolyte.

The selenium and/or tellurium compound which is used in the electrolyte may be selected appropriately by the skilled person within the concentration indicated above. As a preferred concentration range, a concentration of between 0.075-80 mmol/l tellurium/selenium and very preferably between 3.5-40 mmol/l tellurium/selenium may be selected. Compounds which can be added to the electrolyte are considered those compounds of selenium and/or tellurium which have the elements in the oxidation state +4, +6. Particularly preferred are compounds in which the stated elements have the +4 oxidation states. Especially preferred are those selected from the group consisting of tellurites, selenites, tellurous acid, selenous acid, telluric acid and selenate and also tellurate in this context, with the use of tellurium being generally presently preferred over selenium. Especially preferred is the addition of the tellurium to the electrolyte in the form of a salt of tellurous acid, as for example in the form of potassium tellurite.

In the electrolyte of the invention, moreover, a sulfonic acid is used in a sufficient concentration of 0.25-4.75 mol/l. The concentration is preferably 0.5-3 mol/l and very preferably 0.8-2.0 mol/l. The sulfonic acid serves on the one hand to establish a corresponding pH in the electrolyte. On the other hand, its use leads to further stabilization of the electrolyte of the invention. The upper limit on the concentration of sulfonic acid is imposed by the fact that at too high a concentration only silver will still be deposited. As sulfonic acid it is possible in principle to employ sulfonic acids known to the skilled person for use in electroplating. Employed with preference are sulfonic acids selected from the group consisting of ethanesulfonic acid, propanesulfonic acid, benzenesulfonic acid, and methanesulfonic acid. Deserving particularly preferential mention in this context are propanesulfonic acid and methanesulfonic acid. Methanesulfonic acid is used with utmost preference.

In a further embodiment, the present invention relates to a method for the electrolytic deposition of silver-palladium coats comprising predominantly silver from an electrolyte of the invention, wherein an electrically conductive substrate is immersed into the electrolyte and a current flow is established between an anode in contact with the electrolyte, and the substrate as cathode. It may be noted that the embodiments stated as preferable for the electrolyte are also applicable mutatis mutandis to the method addressed here.

The temperature which prevails during the deposition of the silver-palladium alloy may be selected arbitrarily by the skilled person. Said skilled person will be guided on the one hand by a sufficient deposition rate and employable current density range, and on the other hand by economic considerations and/or the stability of the electrolyte. The establishment of a temperature of 45° C. to 60° C. in the electrolyte is advantageous. Appearing particularly preferred is the use of the electrolyte at temperatures of 45° C. to 55° C., and very preferably of around 50° C.

The current density which is established between the cathode and the anode during the deposition method in the electrolyte may be selected by the skilled person in accordance with the efficiency and quality of deposition. Depending on application and type of coating installation, the current density in the electrolyte will be set advantageously at 0.5 to 100 A/dm$^2$. The current densities may optionally be raised or lowered by adaptation of the installation's parameters such as construction of the coating cell, flow rates, anode conditions and cathode conditions, etc. Advantageous is a current density of 1-50 A/dm$^2$, preferably 2-20 A/dm$^2$, and very preferably 2.5-12 A/dm$^2$.

As already indicated above, the electrolyte of the invention is an acidic electrolyte. The pH ought preferably to be <2, more preferably <1. It may be the case that fluctuations occur in the pH of the electrolyte during the electrolysis. In one preferred embodiment of the present method, therefore, the procedure adopted by the skilled person is to monitor the pH during the electrolysis and, where appropriate, adjust it to the setpoint value.

In connection with the use of the electrolyte, a variety of anodes can be used. Soluble or insoluble anodes are just as suitable as the combination of soluble and insoluble anodes. If a soluble anode is used, it is particularly preferred if a silver anode is employed.

Insoluble anodes used are preferably those made of a material selected from the group consisting of platinized titanium, graphite, mixed iridium transition-metal oxide, and specific carbon material ("Diamond-Like Carbon" DLC) or combinations of these anodes. Particularly preferred for performing the invention are mixed oxide anodes composed of iridium ruthenium mixed oxide, iridium ruthenium titanium mixed oxide or iridium tantalum mixed oxide. Further examples may be found in Cobley, A. J. et al. (The use of insoluble anodes in Acid Sulphate Copper Electrodeposition Solutions, Trans IMF, 2001, 79(3), pp. 113 and 114).

Wetting agents which can be used in the electrolyte of the invention are typically anionic and nonionic surfactants, such as, for example, polyethylene glycol adducts, fatty alcohol sulfates, alkyl sulfates, alkylsulfonates, arylsulfonates, alkylarylsulfonates, heteroaryl sulfates, betaines, fluorosurfactants, and salts thereof and derivatives thereof (see also: Kanani, N: Galvanotechnik [Electroplating]; Hanser Verlag, Munich Vienna, 2000; page 84 ff).

The present invention presents a new electrolyte for the electrolytic deposition of silver-palladium coats, and also a corresponding method. In spite of the relatively simple configuration, the electrolyte is extremely stable even with respect to high current densities, and permits a homogeneous and compositionally uniform deposition of corrosion-resistant silver-palladium alloys on electrically conductive substrates, even across a broad range of current densities. A substantial advantage of the electrolyte composition of the invention is the excellent stability of the electrolyte. This is manifested in the absence of precipitates (FIG. 1). The electrolyte described in the AiF report (see above), in contrast, displays distinct precipitations, brown to black in color, after just a short period of operation (FIG. 2). Such precipitations frequently necessitate costly and inconvenient analyses and cleaning measures with corresponding losses of precious metal. Through the combination of the features of the electrolyte of the invention, characteristics are obtained which suggest its extremely advantageous use in the industrial manufacture of—in particular—contact materials. This was not readily predictable against the background of the known prior art.

FIGURES

FIG. 1: Coating cell after testing of the inventive electrolyte, with no precipitations on the container/cell walls.

FIG. 2: Coating cell after testing of the AiF electrolyte (report of Forschungsinstitut Edelmetallchemie & Metallchemie aus Schwäbisch Gmünd; project number: AiF 14160 N), with dark precipitations on the container/cell walls.

Figure 3:
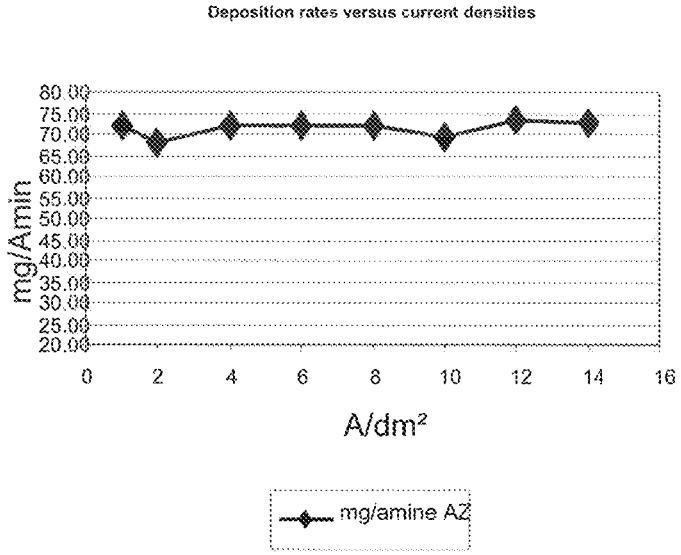

FIG. 3: FIG. 3 shows the change in the deposition rate with the current density selected. It is apparent that deposition occurs at virtually the same rate across a wide current density range.

Figure 4:
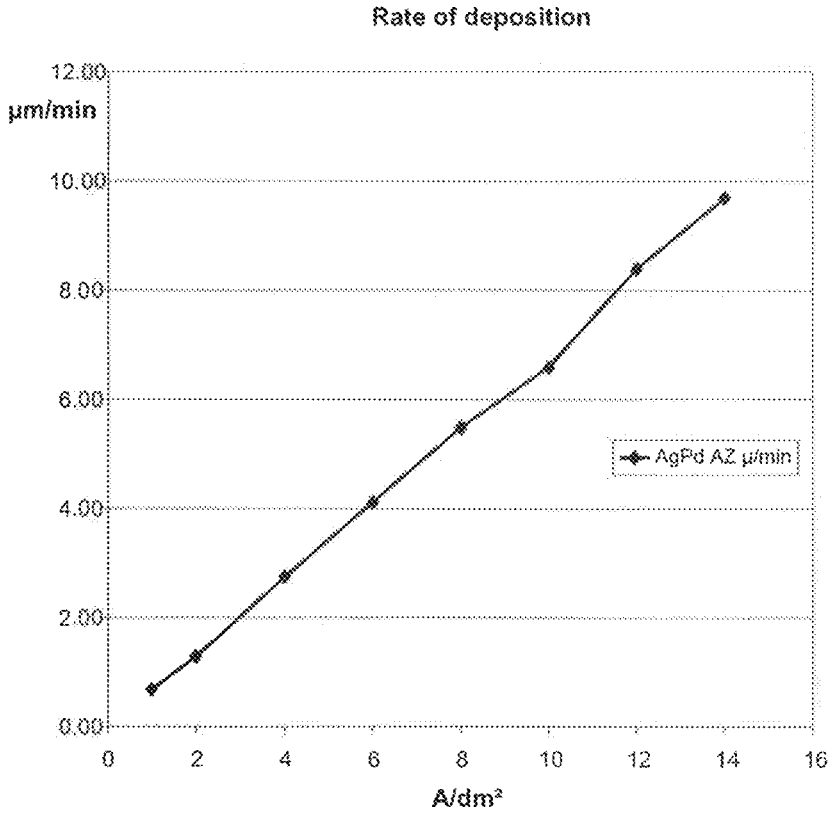

FIG. 4: FIG. 4 shows the evolution of the rate of deposition as a function of the current density. Evident here is a preferred linear dependence between the parameters.

Embodiments of the electrolyte for high-speed applications:

EXAMPLE 1

50 ml/l 70% methanesulfonic acid
3 g/l glycine
10 g/l palladium (as palladium hydroxide)
10 g/l silver (as silver methanesulfonate)
0.5 g/l tellurium (as tellurous acid)
Temperature: 50° C.
Anodes: PtTi
Current density: 1 to 14 A/dm$^2$
Weight of deposit: see FIG. 3
Deposition rate: see FIG. 4

Alloy composition obtained over the indicated current density range: 90% by weight silver, 7-8% by weight palladium, and 3-2% by weight tellurium.

EXAMPLE 2

80 ml/l 70% methanesulfonic acid
5 g/l alanine
10 g/l palladium (as palladium chloride)
6 g/l silver (as silver carbonate)
1.0 g/l tellurium (as potassium tellurite)
Temperature: 60° C.
Anodes: PtTi
Current density: 0.5 to 12 A/dm$^2$ Alloy composition obtained over the indicated current density range: 88% by weight silver, 7-10% by weight palladium, and 5-2% by weight tellurium.

EXAMPLE 3

100 ml/l 70% methanesulfonic acid
5 g/l valine
8 g/l palladium (as palladium hydroxide)
15 g/l silver (as silver nitrate)
1.5 g/l tellurium (as tellurous acid)
Temperature: 60° C.
Anodes: graphite
Current density: 1 to 20 A/dm$^2$ Alloy composition obtained over the indicated current density range: 92% by weight silver, 3-4% by weight palladium, and 5-4% by weight tellurium.

EXAMPLE 4

150 ml/l 70% methanesulfonic acid
2 g/l glycine
15 g/l palladium (as palladium sulfate)
8 g/l silver (as silver carbonate)
0.5 g/l tellurium (as tellurous acid)
Temperature: 55° C.
Anodes: PtTi
Current density: 1 to 16 A/dm$^2$ Alloy composition obtained over the indicated current density range: 90% by weight silver, 8-9% by weight palladium, and 2-1% by weight tellurium.

EXAMPLE 5

100 ml/l 70% methanesulfonic acid
1 g/l glycine
3 g/l alanine
15 g/l palladium (as palladium methanesulfonate)
8 g/silver (as silver nitrate)
2.0 g/tellurium (as tellurous acid)
Temperature: 60° C.
Anodes: graphite
Current density: 1 to 28 A/dm$^2$ Alloy composition obtained over the indicated current density range: 87% by weight silver, 9-10% by weight palladium, and 4-3% by weight tellurium.

The invention claimed is:

1. A cyanide-free, acidic, and aqueous electrolyte for the electrolytic deposition of silver-palladium alloys comprising 70 to 99 percent by weight of silver, said electrolyte comprising in dissolved form:

1) a silver compound in a concentration of 0.01-2.5 mol/l silver;
2) a palladium compound in a concentration of 0.002-0.75 mol/l palladium;
3) a tellurium compound or selenium compound in a concentration of 0.075-80 mmol/l tellurium/selenium;
4) urea in a concentration of 0.2-2 mol/l, and/or one or more amino acids selected from the group consisting of:
   alanine, aspartic acid, cysteine, glutamine, glutamic acid, glycine, lysine, leucine, methionine, phenylalanine, phenylglycine, proline, serine, tyrosine, and valine, in a concentration of 0.2-35 mmol/l; and
5) a sulfonic acid in a concentration of 0.25-4.75 mol/l, wherein the electrolyte has a pH of <2.

2. The electrolyte as claimed in claim 1,
characterized in that
one or more amino acids selected from the group consisting of glycine, alanine, and valine are used.

3. The electrolyte as claimed in claim 1,
characterized in that
the selenium and/or tellurium is used as a compound in which the selenium and/or tellurium has an oxidation state of +4 or +6.

4. The electrolyte of claim 1, wherein the silver compound is selected from the group consisting of silver carbonate, silver sulfate, silver phosphate, silver pyrophosphate, silver nitrate, silver oxide, and silver lactate.

5. The electrolyte of claim 4, wherein the silver compound is selected from the group consisting of silver carbonate, silver phosphate, silver pyrophosphate, silver oxide, and silver lactate.

6. The electrolyte of claim 1, wherein the silver-palladium alloys comprise 75 to 97 percent by weight of silver.

7. The electrolyte of claim 6, wherein the silver-palladium alloys comprise 85 to 95 percent by weight of silver.

8. A method for the electrolytic deposition of silver-palladium coats comprising 70 to 99 percent by weight of silver from the electrolyte of claim 1, comprising:

immersing an electrically conductive substrate into the electrolyte and
establishing a current flow between an anode in contact with the electrolyte, and the substrate as cathode.

9. The method as claimed in claim 8,
characterized in that
the temperature of the electrolyte is 45-60° C.

10. The method as claimed in claim 8,
characterized in that
the current flow during electrolysis is between 0.5-100 A/dm$^2$.

11. The method as claimed in claim 8,
characterized in that
the electrolyte has a pH and the pH is adjusted continually to a value <1 during electrolysis.

12. A cyanide-free, acidic, and aqueous electrolyte for the electrolytic deposition of silver-palladium alloys comprising predominantly silver, said electrolyte comprising in dissolved form:

1) a silver compound in a concentration of 0.01-2.5 mol/l silver;
2) a palladium compound in a concentration of 0.002-0.75 mol/l palladium;
3) a tellurium compound or selenium compound in a concentration of 0.075-80 mmol/l tellurium/selenium;
4) urea in a concentration of 0.2-2 mol/l, and/or one or more amino acids selected from the group consisting of:
   alanine, aspartic acid, cysteine, glutamine, glutamic acid, glycine, lysine, leucine, methionine, phenylalanine, phenylglycine, proline, serine, tyrosine, and valine, in a concentration of 0.2-35 mmol/l; and
5) a sulfonic acid in a concentration of 0.25-4.75 mol/l, wherein the electrolyte has a pH of <2.

13. The electrolyte of claim 12, wherein the one or more amino acids is selected from the group consisting of glycine, alanine, and valine are used.

14. The electrolyte of claim 12, wherein the selenium and/or tellurium are used as a compound in which the selenium and/or tellurium have an oxidation state of +4 or +6.

15. The electrolyte of claim 12, wherein the silver compound is selected from the group consisting of silver carbonate, silver sulfate, silver phosphate, silver pyrophosphate, silver nitrate, silver oxide, and silver lactate.

16. The electrolyte of claim 15, wherein the silver compound is selected from the group consisting of silver carbonate, silver phosphate, silver pyrophosphate, silver oxide, and silver lactate.

17. A method for the electrolytic deposition of silver-palladium coats comprising predominantly silver from the electrolyte of claim 12, comprising:

immersing an electrically conductive substrate into the electrolyte and establishing a current flow between an anode in contact with the electrolyte, and the substrate as cathode.

18. The method of claim 17, wherein the temperature of the electrolyte is 45-60° C. and the current flow during electrolysis is between 0.5-100 $A/dm^2$.

19. The method of claim 17, wherein the electrolyte has a pH and the pH is adjusted continually to a value <1 during electrolysis.

20. A cyanide-free, acidic, and aqueous electrolyte for the electrolytic deposition of silver-palladium alloys comprising less than 30 percent by weight of palladium, said electrolyte comprising in dissolved form:

1) a silver compound in a concentration of 0.01-2.5 mol/l silver;
2) a palladium compound in a concentration of 0.002-0.75 mol/l palladium;
3) a tellurium compound or selenium compound in a concentration of 0.075-80 mmol/l tellurium/selenium;
4) urea in a concentration of 0.2-2 mol/l, and/or one or more amino acids selected from the group consisting of:

alanine, aspartic acid, cysteine, glutamine, glutamic acid, glycine, lysine, leucine, methionine, phenylalanine, phenylglycine, proline, serine, tyrosine, and valine, in a concentration of 0.2-35 mmol/l; and
5) a sulfonic acid in a concentration of 0.25-4.75 mol/l, wherein the electrolyte has a pH of <2.

21. The electrolyte of claim 20, wherein the silver compound is selected from the group consisting of silver carbonate, silver sulfate, silver phosphate, silver pyrophosphate, silver nitrate, silver oxide, and silver lactate.

22. The electrolyte of claim 20, wherein the selenium and/or tellurium are used as a compound in which the selenium and/ or tellurium have an oxidation state of +4 or +6.

23. A method for the electrolytic deposition of silver-palladium coats comprising less than 30 percent by weight of palladium from the electrolyte of claim 20, comprising: immersing an electrically conductive substrate into the electrolyte and establishing a current flow between an anode in contact with the electrolyte, and the substrate as cathode.

* * * * *